US009428876B2

(12) United States Patent
Kwon et al.

(10) Patent No.: US 9,428,876 B2
(45) Date of Patent: Aug. 30, 2016

(54) MULTI-SUCTION-PILE ANCHOR AND FLAT PLATE ANCHOR HAVING SUCTION PILES

(71) Applicant: KOREA INSTITUTE OF OCEAN SCIENCE & TECHNOLOGY, Ansan-si, Gyeonggi-do (KR)

(72) Inventors: O Soon Kwon, Suwon-si (KR); Myoung Hak Oh, Yongin-si (KR); In Sung Jang, Gwangmyeong-si (KR)

(73) Assignee: KOREA INSTITUTE OF OCEAN SCIENCE & TECHNOLOGY, Ansan-Si, Gyoenggi-Do (KR)

( * ) Notice: Subject to any disclaimer, the term of this patent is extended or adjusted under 35 U.S.C. 154(b) by 0 days.

(21) Appl. No.: 14/438,208

(22) PCT Filed: May 26, 2014

(86) PCT No.: PCT/KR2014/004659

§ 371 (c)(1),
(2) Date: Apr. 23, 2015

(87) PCT Pub. No.: WO2014/204107

PCT Pub. Date: Dec. 24, 2014

(65) Prior Publication Data

US 2015/0275461 A1 Oct. 1, 2015

(30) Foreign Application Priority Data

Jun. 18, 2013 (KR) ..... 10-2013-0069674
Mar. 7, 2014 (KR) ..... 10-2014-0027284

(51) Int. Cl.
*E02D 13/04* (2006.01)
*E02D 13/00* (2006.01)

(Continued)

(52) U.S. Cl.
CPC ..... *E02D 13/00* (2013.01); *E02D 7/00* (2013.01); *E02D 13/04* (2013.01); *E02D 27/12* (2013.01); *E02D 27/52* (2013.01); *E02D 31/08* (2013.01)

(58) Field of Classification Search
CPC ..... B63B 21/27; E02D 2250/0053; E02D 13/00; E02D 27/12; E02D 27/52
See application file for complete search history.

(56) References Cited

U.S. PATENT DOCUMENTS 3,817,040 A * 6/1974 Stevens ..... E02D 7/24 114/295
4,432,671 A * 2/1984 Westra ..... B63B 21/27 114/296

(Continued)

FOREIGN PATENT DOCUMENTS

JP 61-049029 A 3/1986
KR 10-0459985 B1 12/2004

(Continued)

OTHER PUBLICATIONS

PCT International Search Report, PCT/KR2014/004659, Sep. 1, 2014, 4 Pages.

*Primary Examiner* — Benjamin Fiorello
*Assistant Examiner* — Aaron Lembo
(74) *Attorney, Agent, or Firm* — Fenwick & West LLP

(57) ABSTRACT

A multi-suction pile anchor and a plate anchor for mooring a marine structure, comprises a plurality of suction piles connected in parallel with the same capacity penetrates into the sea floor, wherein a pullout resistance required for mooring the marine structure is applied by changing the number of suction piles, and wherein a plurality of suction piles is connected each other with a connecting plate to increase a lateral resistance.

1 Claim, 21 Drawing Sheets

(51) Int. Cl.

| | |
|---|---|
| ***E02D 27/52*** | (2006.01) |
| ***E02D 7/00*** | (2006.01) |
| ***E02D 27/12*** | (2006.01) |
| ***E02D 31/08*** | (2006.01) |

(56) References Cited

U.S. PATENT DOCUMENTS

| | | | | | |
|---|---|---|---|---|---|
| 4,510,985 | A * | 4/1985 | Arnim, II | E21B 7/122 | 166/349 |
| 4,558,744 | A * | 12/1985 | Gibb | E21B 7/185 | 166/222 |
| 4,706,757 | A * | 11/1987 | Harrington | E21B 33/035 | 166/349 |
| 5,050,680 | A * | 9/1991 | Diehl | E21B 33/037 | 137/312 |
| 5,244,312 | A * | 9/1993 | Wybro | E02B 17/00 | 166/338 |
| 5,526,882 | A * | 6/1996 | Parks | E21B 41/08 | 166/339 |
| 6,203,248 | B1 * | 3/2001 | Childers | E02B 17/02 | 114/296 |
| 6,488,446 | B1 * | 12/2002 | Riemers | B63B 21/27 | 114/296 |
| 6,685,396 | B1 * | 2/2004 | Bergeron | B63B 21/04 | 114/296 |
| 6,719,496 | B1 * | 4/2004 | Von Eberstein | B63B 21/22 | 114/296 |
| 7,976,246 | B1 * | 7/2011 | Krabbendam | B63B 21/27 | 114/230.1 |
| 8,162,061 | B2 * | 4/2012 | Maxwell | E21B 33/10 | 166/177.4 |
| 8,215,873 | B1 * | 7/2012 | Lugo | E02D 5/80 | 285/276 |
| 2007/0140796 | A1 * | 6/2007 | Alhayari | B63B 21/27 | 405/224.1 |
| 2009/0052994 | A1 * | 2/2009 | Lawler | E02D 27/52 | 405/224 |
| 2009/0100724 | A1 * | 4/2009 | McCoy, Jr. | E02F 3/905 | 37/317 |
| 2009/0123235 | A1 | 5/2009 | MacOnochie et al. | | |
| 2011/0297390 | A1 | 12/2011 | Kocaman et al. | | |
| 2012/0024535 | A1 * | 2/2012 | Lieske, II | E21B 43/0122 | 166/363 |
| 2012/0266801 | A1 * | 10/2012 | Brinkmann | B63B 21/50 | 114/293 |
| 2013/0239867 | A1 * | 9/2013 | Horton, III | F16L 3/12 | 114/264 |
| 2013/0292128 | A1 * | 11/2013 | Brinkmann | E02D 23/02 | 166/344 |
| 2015/0308210 | A1 * | 10/2015 | Hanna | E21B 43/0122 | 166/342 |

FOREIGN PATENT DOCUMENTS

| | | | |
|---|---|---|---|
| KR | 10-2009-0084172 | A | 8/2009 |
| KR | 20090099169 | A * | 9/2009 |
| KR | 20130015315 | A * | 2/2013 |
| KR | 101251414 | B1 * | 4/2013 |

* cited by examiner

MULTI-SUCTION-PILE ANCHOR AND FLAT PLATE ANCHOR HAVING SUCTION PILES

TECHNICAL FIELD

This invention relates to an anchor installed in the sea floor for fixing or mooring a marine structure, and more particularly, to a multi-suction pile anchor and a plate anchor having suction pile, in which when installing an anchor for mooring a marine structure in the sea floor, a plurality of suction piles connected in parallel with the same capacity penetrates into the sea floor and then serves as anchor, wherein a pullout resistance required for mooring the marine structure is applied by changing the number of suction piles without increasing a cross-sectional area of the suction pile, and wherein a plurality of suction piles is connected each other with a connecting plate to increase a lateral resistance without enlarging the diameter of the suction pile.

BACKGROUND ART

Generally, in order to install a marine structure such as an oil drilling facility or a wind power generation facility on the sea, a stable fixing force for minimizing shake of the marine structure needs. Further, in order to fix a location of the marine structure, an anchor penetrated into the sea floor is connected to the marine structure through a connecting cable. When the anchor is penetrated into the sea floor, a pile descends from the marine structure to the sea floor, and the anchor provided at the lower end of the pile is located at the sea floor and driven into the sea floor so that the anchor is installed in the sea floor.

A suction pile is installed at the ground by using a pressure difference between an inside and an outside of the suction pile, which is generated when a fluid such as water or air provided therein is pumped outwards. The pressure of inside of the suction pile is equal to or lower than a hydrostatic pressure. The suction pile may be used not only at the sea floor but also at the ground below a water surface, which may cause suction. The suction pile penetrates into the surface layer of the ground due to its weight, and then the water contained therein is forcibly discharged using a pump to generate a suction operation. The suction pile is also called a bucket pile.

The suction pile is shaped like a hollow caisson having a cylindrical shape without a bottom plate. However, a cross-sectional shape of the suction pile is not limited to a cylindrical shape. In order to facilitate the suction, the top portion of the suction pile is closed. The suction pile is installed as briefly explained below.

First, if the suction pile is placed on an underwater bottom (for example, the sea floor), a lower end of the suction pile penetrates to a certain depth from the underwater bottom due to the weight of the suction pile. In this state, a suction device such as an underwater pump installed at the top of the suction pile is operated to pump water contained in the suction pile outwards. Accordingly, the interior in the suction pile is depressurized, and therefore, a differential water pressure on the interior and exterior of the suction pile is caused. In this state, the force is in an equilibrium state with respect to the suction pile in a horizontal direction, but a downward pressing force is generated in a vertical direction, and the suction pile penetrates into the ground due to the generated vertical pressing force.

The underwater pump is installed at the top of the suction pile as described above, and on the sea, a worktable is prepared at a barge or a general ship. Here, a crane for installing the suction pile and a location finder for measuring a location under the sea are provided at the worktable. Therefore, if the suction pile is located at an installation location in the sea and then the water in the suction pile is discharged out by operating the underwater pump, a pressure difference is generated between the inside and outside of the suction pile, and the suction pile is driven into the ground due to the pressure difference.

A resistance for preventing the suction pile from penetrating into the underwater ground is determined by a front supporting force applied to the bottom portion of the suction pile and a skin friction force, and if a penetrating force of the suction pile is greater than the resistance, the suction pile penetrates into the underwater ground. The penetrating force of the suction pile is proportional to the pressure difference between the interior and exterior of the suction pile and a cross-sectional area of the suction pile (namely, a square of diameter of the suction pile), but the resistance is proportion to the diameter of the suction pile. Therefore, if the suction pile has a greater diameter, the suction pile may penetrate into the underwater ground with a smaller pressure difference.

In an existing technique in relation to the anchor, in order to install a burying-type anchor with a great supporting force at the sea floor, the sea floor is excavated and the anchor is located at the excavated place, and then the excavated place is filled and covered again with soil. However, this existing method causes environmental pollutions due to excavation and covering of the sea floor.

As another method, a pile is dropped from a barge to the sea floor, and an anchor is provided with the bottom of the pile, where the pile is rotated to drive the anchor into the sea floor. However, this technique is not available at a very deep sea.

Meanwhile, Korean Patent No. 10-0459985 (entitled a suction pile anchor), Related Prior Art No. 1, discloses an anchor which may be easily installed at a deep sea.

Regarding a suction pile anchor installed in the water, a circular hydraulic jack is fixedly installed at the bottom of a suction pile, and a hydraulic line for operating the hydraulic jack is installed through an inside of the suction pile and a top of the suction pile and connected to the hydraulic linkage on the sea. The top of the suction pile is connected to a crane on the sea, and a pipe for discharging water introduced into the suction pile is installed at the top of the suction pile and connected to a pump on the sea. The anchor is coupled to the suction pile by the hydraulic jack, and in a state where the anchor is driven into the sea floor to a predetermined depth, the hydraulic jack operates to separate the suction pile from the anchor. One side of a wire is fixedly installed to the outer side of the anchor.

Since the anchor is attached and installed to the bottom of the suction pile through the hydraulic jack, the anchor may be easily installed, and it is not required for excavating or covering the seabed, which allows installation of the anchor at a deep sea. In addition, since the suction pile and the hydraulic jack may be reused, costs may be reduced.

However, in the above existing technique, if a marine structure is relatively great, the capacity of the anchor should be set according to a pullout resistance of the marine structure, and thus a lot of costs are required for manufacturing the anchor. In addition, due to a great capacity of the anchor, the anchor may not be easily penetrated into the sea floor. In addition, in the above existing technique, the suction pile penetrates the sea floor in a vertical direction, and due to a small contact surface in a lateral direction, a lateral resistance is weak.

Moreover, even though a large-capacity anchor is recently demanded since a buoyance marine structure becomes greater, it is not easy to increase the size of the suction pile due to the limit to capacity of a transportation ship and equipment for suction.

DISCLOSURE

Technical Problem

The present disclosure is directed to providing an anchor installed in a sea floor, which includes a plurality of suction piles connected in parallel with the same capacity, wherein the suction piles is forced into the sea floor by means of suction, and the suction piles moor a marine structure with a connecting cable.

In addition, the present disclosure is directed to solving a problem that a rate of increase of the anchor capacity decreases even though a size or cross-sectional area of the suction pile is increased to enhance the capacity of the anchor. For this, in the present invention, a plurality of suction piles is connected in parallel and utilized as an anchor, thereby enhancing the capacity of the anchor.

Moreover, the present disclosure is directed to providing a plate anchor having a plurality of suction piles. The plate anchor of the present disclosure includes a plurality of suction piles connected together with a connecting flat plate, and therefore, if the plate anchor of the present disclosure is used, a lateral resistance may be increased by increasing a lateral contact area without enlarging the diameter of the suction pile.

Technical Solution

For the above-mentioned purposes, this invention may include at least two suction piles arranged in parallel, each suction pile being configured as a hollow cylindrical member having an open bottom to be opened downwards for suction and a drainage hole formed at top for penetrating into a sea floor by suction; and a coupling plate for keeping the suction piles in a connected state, wherein an end of a connecting cable connected to a marine structure for mooring the marine structure is connected to one side of the coupling plate.

Further, in this invention, the coupling plate may be a first and second coupling plates located in parallel to face each other and coupled to outer sides of the suction piles.

Further, in this invention, at least one partitioning plate may be provided between the first coupling plate and the second coupling plate so that the plurality of the suction piles is isolated.

In another aspect of the present disclosure, there is provided a method for constructing a multi-suction pile anchor, which includes: a suction pile number setting step of setting the number of suction piles according to a pullout resistance condition demanded by a marine structure; a suction pile parallel-arrangement step of arranging the suction piles in parallel; a suction pile fixing step of integrally coupling the arranged suction piles by using a coupling plate; a suction pile position fixing step of placing the assembled suction piles on a sea floor to penetrate to a predetermined depth by a weight thereof; a suction pile penetration step of operating a suction pump for sucking water from the hollow inside of the suction piles through a drainage hole to generate a suction pressure in the suction piles so that the suction piles penetrate into a sea floor till a design depth due to the suction pressure; and a marine structure restraining step of connecting a connecting cable, connected to the coupling plate, to the marine structure for mooring the marine structure, when the suction piles entirely penetrate into the sea floor.

In another aspect of the present disclosure, there is provided a plate anchor having a suction pile, which includes: a plurality of suction piles configured to penetrate into the ground due to a penetration promotion effect and a water pressure difference generated by pumping an internal water; and a connecting flat plate configured to connect a pair of suction piles adjacent to each other.

The plate anchor having a suction pile according to the present disclosure may be composed of two suction piles and a single connecting flat plate for connecting both suction piles, and a padeye (connector) may be provided at a front portion of the connecting flat plate so that a connecting cable is connected thereto.

The plate anchor having a suction pile according to the present disclosure may be composed of two suction piles and a single connecting flat plate for connecting both suction piles, and a padeye may be provided at a front portion of an outer circumference of each suction pile so that a connecting cable is connected thereto.

The plate anchor having a suction pile according to the present disclosure may be composed of three suction piles and two connecting flat plates, the connecting flat plates may be respectively installed between the left suction pile and the central suction pile and between the central suction pile and the right suction pile, and a padeye may be provided at a front portion of an outer circumference of each suction pile so that a connecting cable is connected thereto.

The plate anchor having a suction pile according to the present disclosure may include a reuse unit and a penetrating unit detachably connected to a lower portion of the reuse unit.

In the plate anchor having a suction pile according to the present disclosure, a reinforcement plate may be provided at an outer side of the suction pile penetrating unit.

The plate anchor having a suction pile according to the present disclosure may be composed of two suction piles and a single connecting flat plate, the connecting flat plate may be provided between the penetrating units of both suction piles, and a padeye may be provided at a front portion of the connecting flat plate so that a connecting cable is connected thereto.

The plate anchor having a suction pile according to the present disclosure may be composed of two suction piles and a single connecting flat plate, the connecting flat plate may be provided between the penetrating units of both suction piles, and a padeye may be provided at a front portion of an outer circumference of the penetrating unit of each suction pile so that a connecting cable is connected thereto.

The plate anchor having a suction pile according to the present disclosure may be composed of two suction piles and a single connecting flat plate, the connecting flat plate may be provided between the penetrating units of both suction piles, and a padeye may be provided at a front portion of the reinforcement plate so that a connecting cable is connected thereto.

Advantageous Effects

According to the present invention, the anchor installed at the sea floor includes a plurality of suction piles connected in parallel with the same capacity. The anchor of the present invention penetrates into the sea floor by means of suction of each suction pile. Therefore, the anchor may be easily manufactured and easily installed, and thus the marine structure may be easily moored. In addition, since a plurality of suction piles is connected each other in parallel and does function as an anchor, the efficiency of the anchor (anchor capacity/anchor weight) may be enhanced.

Moreover, the plate anchor including a suction pile according to the present invention has an increased lateral resistance without increasing the size of the suction pile. In the present invention, a sufficient penetrating force may be ensured since a plurality of suction piles is used, and thus the suction piles may easily penetrate into the ground. Since the plate anchor of the present invention has a great lateral contact area, a member for connecting the connecting cable with the anchor may be designed in various ways, and the connecting cable may be stably connected to the anchor. In the present invention, the suction pile penetrating into the ground may be pulled from the sea floor and then reused.

BEST MODE

Figure 1:
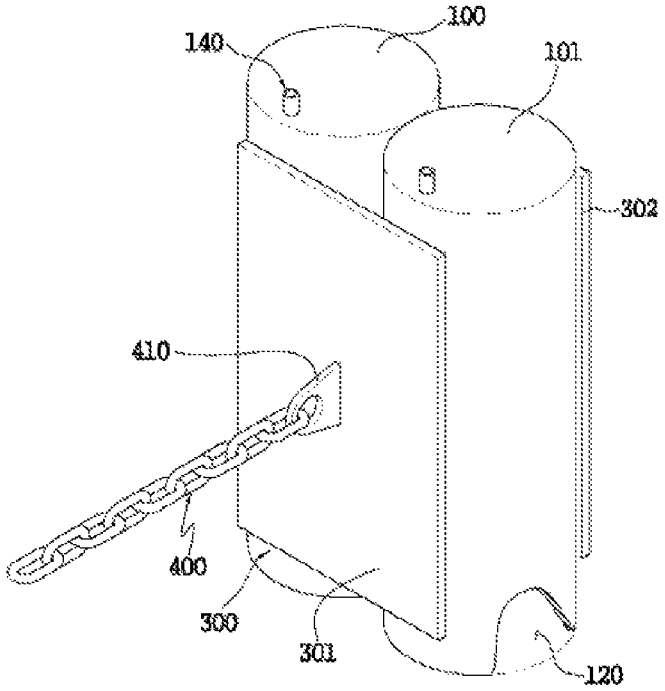
FIG. 1 is a perspective view showing a multi-suction pile anchor according to a first embodiment of the present invention.

Hereinafter, the embodiments of the present invention will be described in detail with reference to the accompanying drawings. However, the following embodiments will be just a reference for ordinary peoples of this technology, and the technical spirit, essence and operations of the present invention are not limited thereto, and the changes may be possible.

An anchor of the present invention is used for mooring a marine structure on a sea floor and includes a plurality of suction piles connected each other in parallel. The plurality of suction piles penetrates into the sea floor and serves as an anchor.

<First Embodiment>

As shown in FIGS. 1 to 4, a suction anchor of the present invention comprises a plurality of suction piles 100, 101 arranged in parallel to penetrate into a sea floor by means of suction operation, a coupling plate 300 configured to unite the suction piles 100, 101, and a connecting cable 400 configured to connect the coupling plate 300 to a marine structure so that the suction piles 100, 101 moor the marine structure.

There are provided at least two suction piles 100, 101, and the number of suction piles 100, 101 may be determined according to a pullout resistance required for mooring a marine structure. The suction piles 100, 101 are made of hollow cylindrical members, similar to an existing technique. An opening 120 opened downwards is formed at a bottom of the suction pile, and a top surface of the suction pile is closed but a drainage hole 140 for suction is formed at the top surface.

A pump for suction is connected to the drainage hole 140. The pump may be an underwater pump directly installed on the suction pile, but may also be a pump installed at a marine structure such as a barge and connected to the drainage hole 140 through a hose.

Therefore, when the suction piles 100, 101 are placed on the sea floor and the weight of the suction piles drives them partially into the surface of the sea floor, water is pumped out from the insides of the suction piles 100, 101 through the drainage hole 140 by operation of the suction pump, and therefore, a suction pressure is applied to the suction piles 100, 101, and thus, the suction piles 100, 101 penetrate into the sea floor.

In other words, if the suction pump is operated in a state where the suction piles 100, 101 are placed on a surface of the sea floor and the ends of the suction piles 100, 101 are slightly driven into the sea floor due to their weights, suction is performed while water is drained from the hollow insides of the suction piles 100, 101 through the drainage hole 140, a suction pressure is applied to the suction piles 100, 101, and by this suction pressure, the suction piles 100, 101 penetrate into the sea floor.

Even though not shown in the figures, the suction pump may be installed at the marine structure or the suction pile, and may also be connected to the drainage hole 140 directly or through a valve.

The coupling plate 300 is attached to outsides of the plurality of suction piles 100, 101 arranged in parallel by welding or by a connecting device, and therefore, the coupling plate 300 is integrated with the plurality of suction piles 100, 101. A connecting cable 400 for mooring the marine structure is coupled to one surface of the coupling plate 300.

The connecting cable 400 is used for connecting the marine structure to the coupling plate 300. The connecting cable 400 may be made of a wire, a chain or the like. One end of the connecting cable 400 may be connected to a padeye 410 provided at the coupling plate 300.

The multi-suction pile anchor according to the present invention, configured as above, is constructed as follows.

Figure 2:
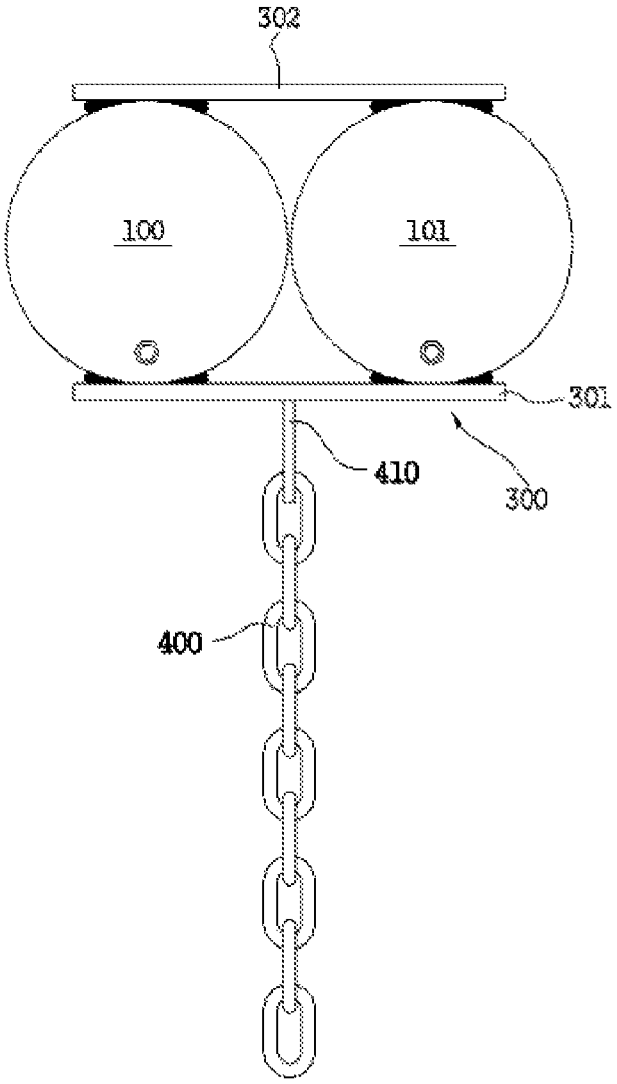
FIG. 2 is a plane view of FIG. 1.
Figure 3:
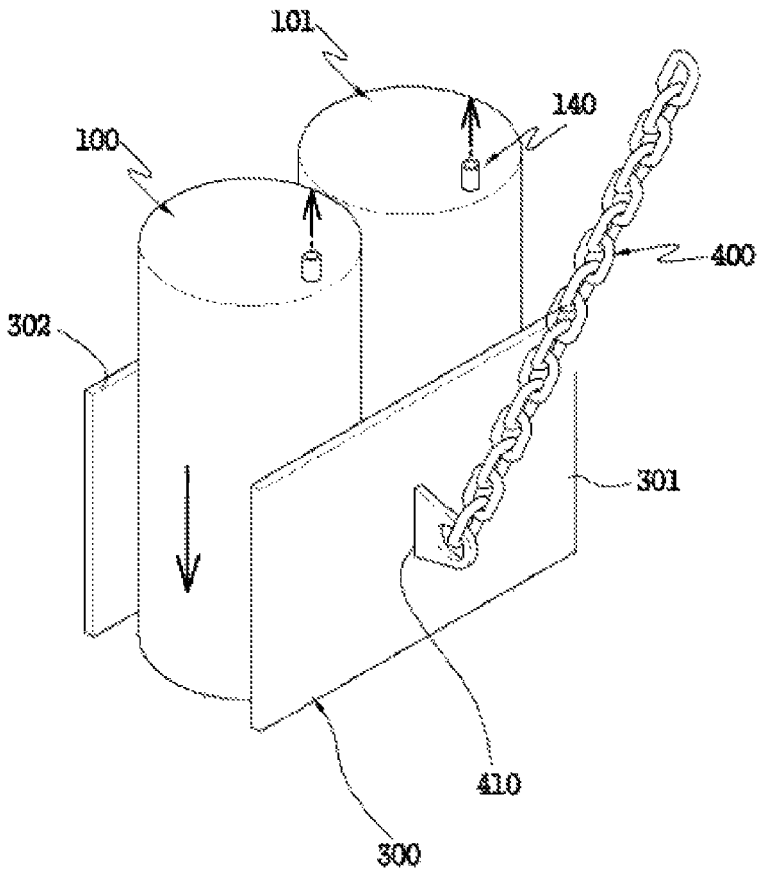
FIG. 3 is a perspective view showing that the multi-suction pile of FIG. 1 is placed on the sea floor.
Figure 4:
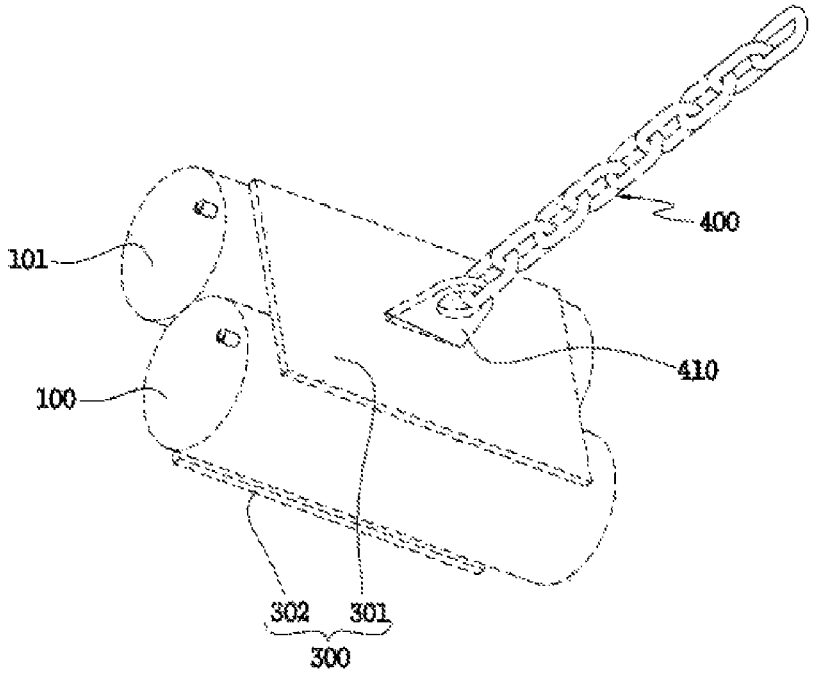
FIG. 4 is a perspective view showing that the multi-suction pile of FIG. 3 has penetrated into the sea floor.

The first step is a step for setting the number of suction piles 100, 101 according to a pullout resistance demanded for mooring a marine structure. Referring to FIGS. 1 and 2, the second step is a suction pile parallel-arrangement step for arranging the plurality of suction piles 100, 101 in parallel. The third step is a suction pile fixing step to couple the coupling plate 300 to the suction piles 100, 101 so that the plurality of suction piles 100, 101 are integrated. The next step is a step to connect the end of the connecting cable 400 to the coupling plate 300. After that, a suction pile position fixing step is performed to place the suction piles 100, 101 on the sea floor so that lower ends of the suction piles 100, 101 penetrate into the sea floor by a certain depth by self weight. After that, a suction pile penetration step is performed to operate the suction pump for pumping water out of the hollow inside of the suction piles 100, 101 through the drainage hole 140 to apply a suction pressure in the suction piles 100, 101. Thus, the suction piles 100, 101 penetrate into a sea floor with a designed depth. In addition, after the suction piles 100, 101 completely penetrate, a marine structure restraining step is performed to install the connecting cable 400 for mooring the marine structure as shown in FIG. 3, and the installation of the suction anchor of this invention is completed thereby.

As described above, in the present invention, the number of suction piles to penetrate into the sea floor depends on the capacity of the anchor responding to the pullout resistance required for mooring the marine structure.

The pullout resistance represents a value of a pullout resistance required for the marine structure to maintain its position steadily with respect to the sea floor against wind.

The member having reference numeral 410 is a padeye 410 provided with the coupling plate 300 for the connection with the connecting cable 400.

<Second Embodiment>

Figure 5:
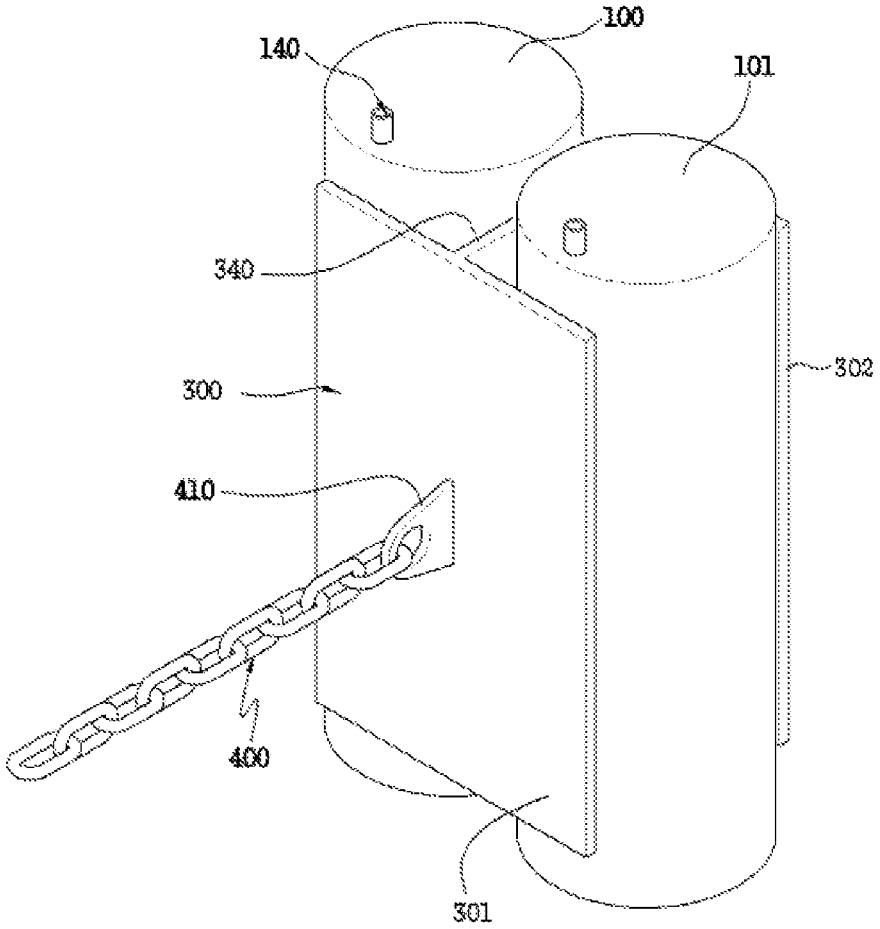
FIG. 5 shows a second embodiment of the present invention.
Figure 6:
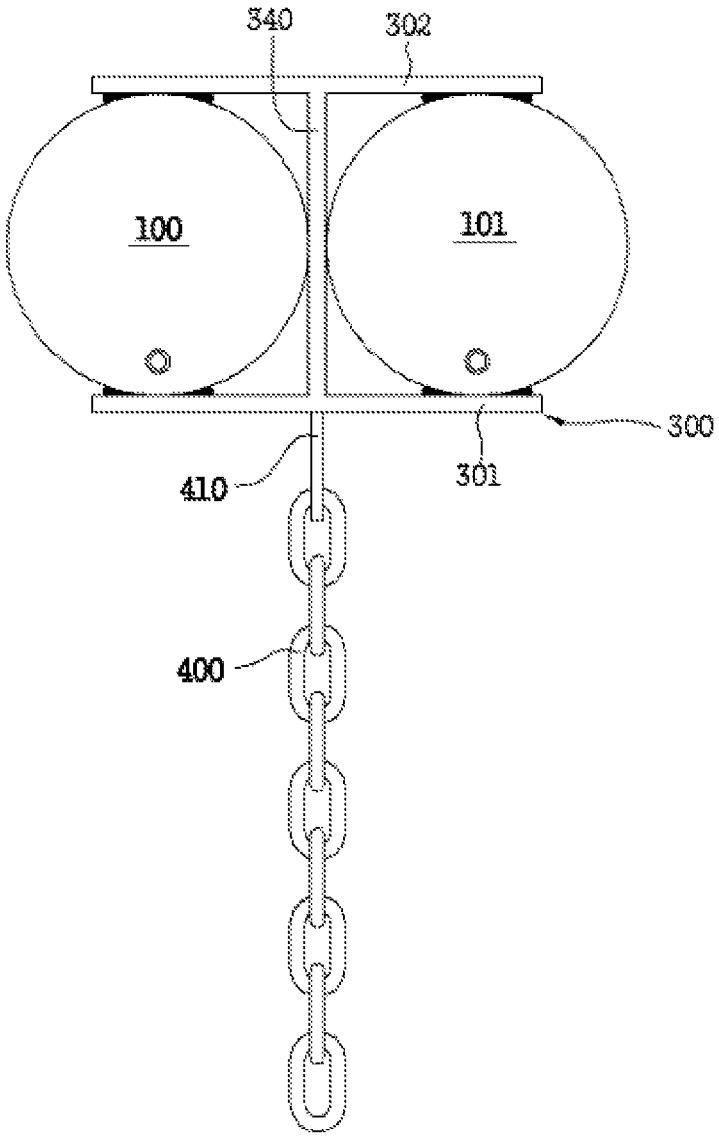
FIG. 6 is a plane view of FIG. 5.
Figure 7:
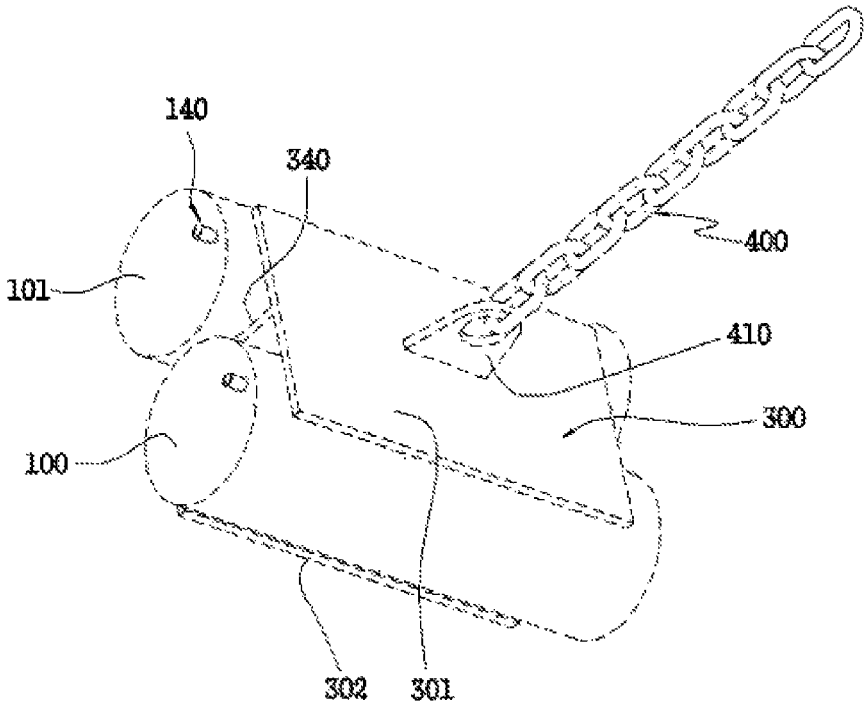
FIG. 7 shows a use state of FIG. 5.

As shown in FIGS. 5 to 7, a suction anchor according to the second embodiment of the present invention comprises a plurality of suction piles 100, 101 arranged in parallel to penetrate into a sea floor by means of suction operation, a first and a second coupling plates 301, 302 disposed in parallel at outer sides of the suction piles 100, 101 to face each other and integrally attached respectively to the suction piles 100, 101 by welding or coupler, and a connecting cable 400 having one end connected to any one of the first and second coupling plates 301, 302 and the other end connected to a marine structure so that the suction piles 100, 101 moor the marine structure.

A partitioning plate 340 is provided between the first and the second coupling plates 301, 302 so that the first and the second coupling plates 301, 302 are united, and the suction piles 100, 101 may be provided at both sides of the partitioning plate 340 in an isolated state and coupled to the first and the second coupling plates 301, 302. In this case, the suction piles 100, 101 may be stably fixed.

The first and the second coupling plates 301, 302 are plate-shaped members, which may be attached to outer sides of the suction piles 100, 101. When the suction piles penetrate into the sea floor, the first and the second coupling plates 301, 302 may also penetrate into the sea floor together with the suction piles 100, 101.

In the second embodiment, the functions of the suction piles 100, 101 and the connecting cable 400 are the same with those of the first embodiment, and therefore, the details of the other features will not described again.

<Third Embodiment>

Figure 8:
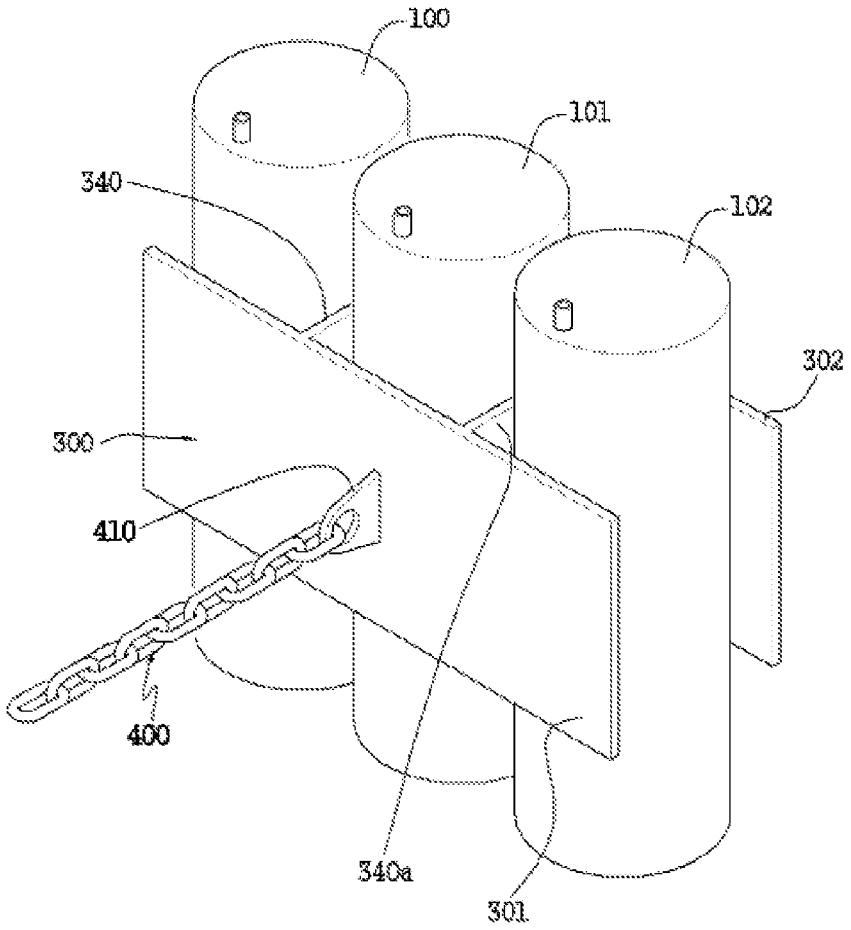
FIG. 8 is a perspective view showing that a plurality of suction piles is provided according to a third embodiment of the present invention.
Figure 9:
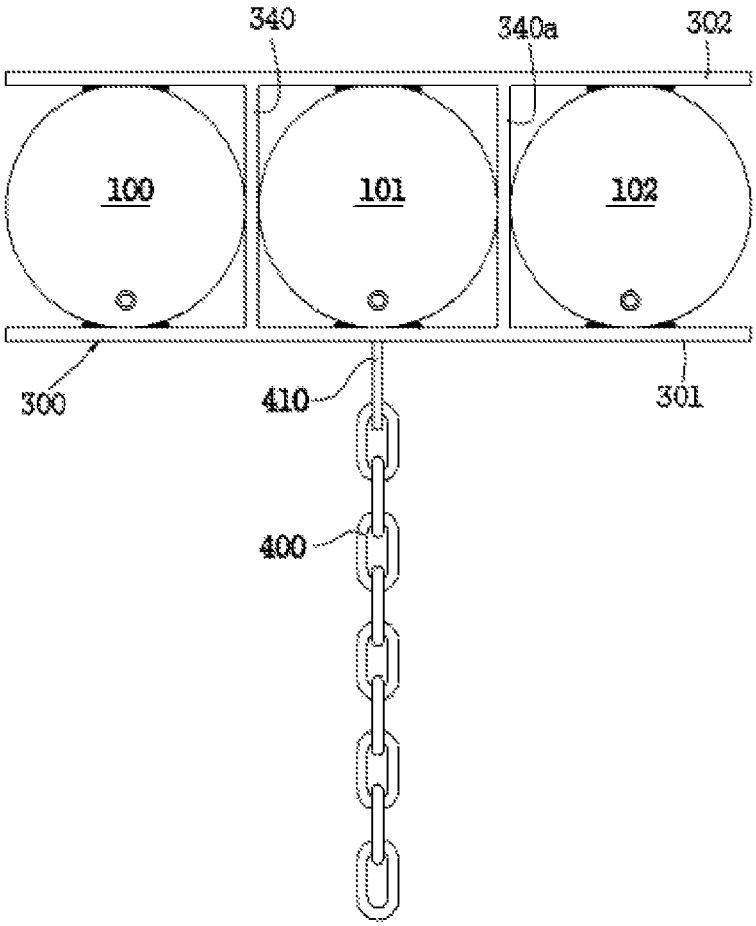
FIG. 9 is a plane view of FIG. 8.
Figure 10:
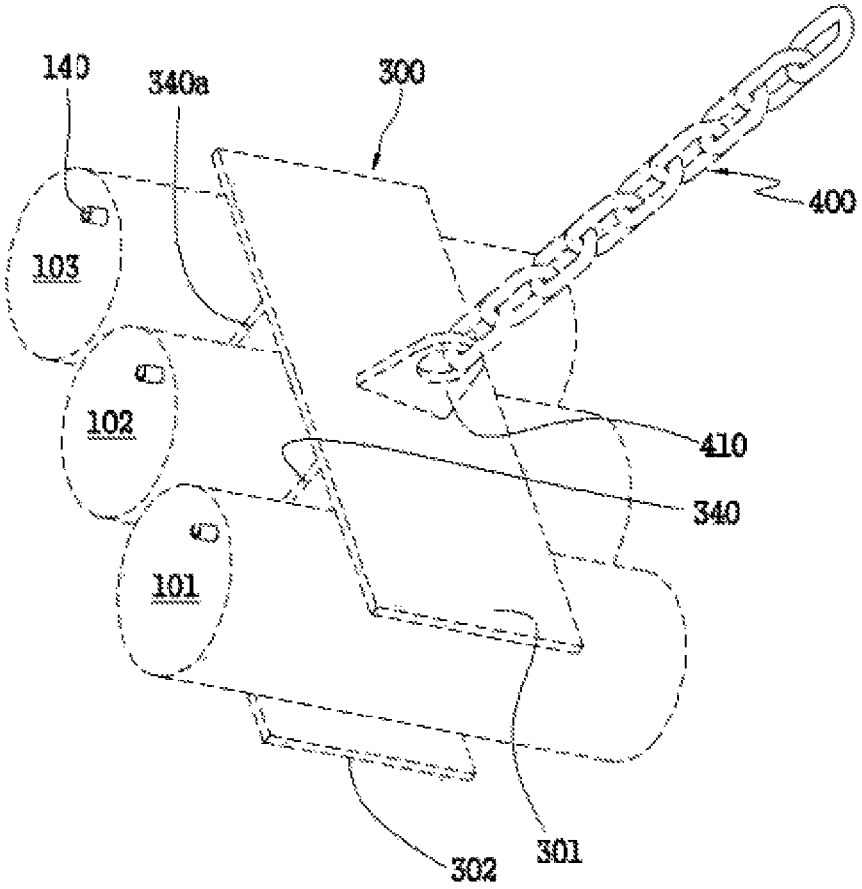
FIG. 10 is a perspective view showing that the multi-suction pile of FIG. 8 has penetrated into the sea floor.

As shown in FIGS. 8 to 10, an anchor according to the third embodiment of the present invention comprises a plurality of partitioning plates 340 provided between the first coupling plate 301 and the second coupling plate 302, and the suction piles 100, 101, 102 coupled in an isolated state between the partitioning plate 340 and another partitioning plate 340*a*. When the marine structure demands a great pullout resistance, the suction piles 100, 101, 102 may ensure a stable mooring force by increasing the number of suction piles without increasing the size of the suction piles. In addition, the suction piles 100, 101, 102 and the first and the second coupling plates 301, 302 may easily penetrate into the sea floor, and when a pullout force is applied to the connecting cable 400 connected to the marine structure, the suction piles 100, 101, 102 may have increased resistance.

<Fourth Embodiment>

Figure 11:
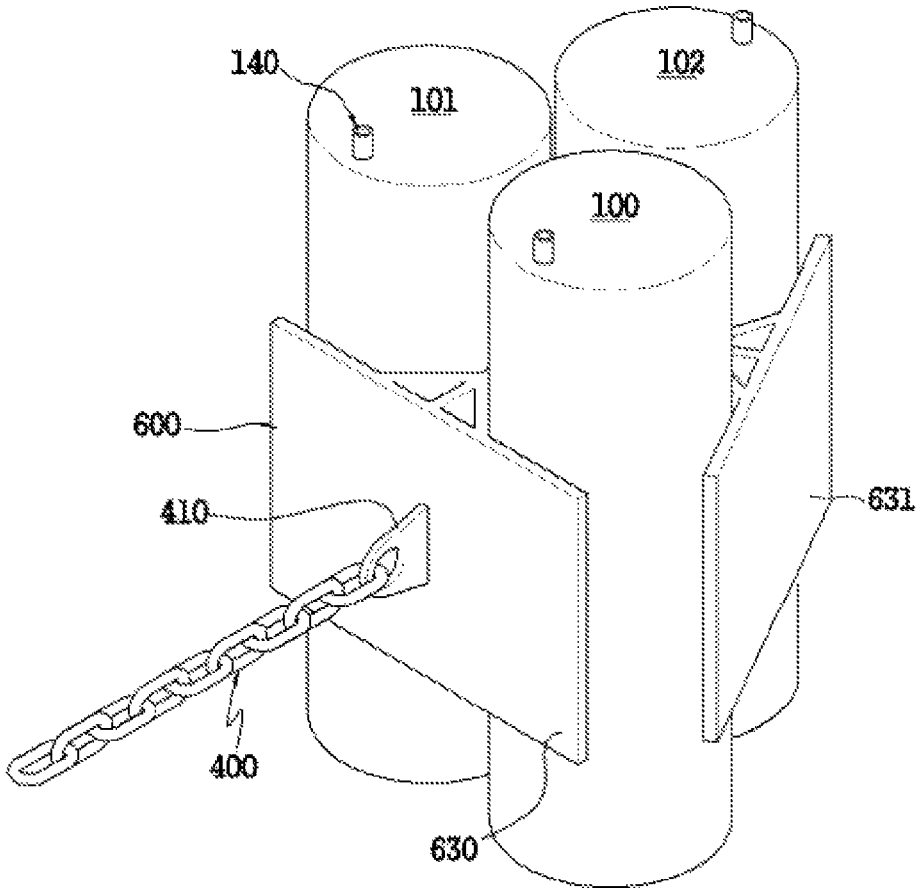
FIG. 11 is a perspective view showing a multi-suction pile anchor according to a fourth embodiment of the present invention.
Figure 12:
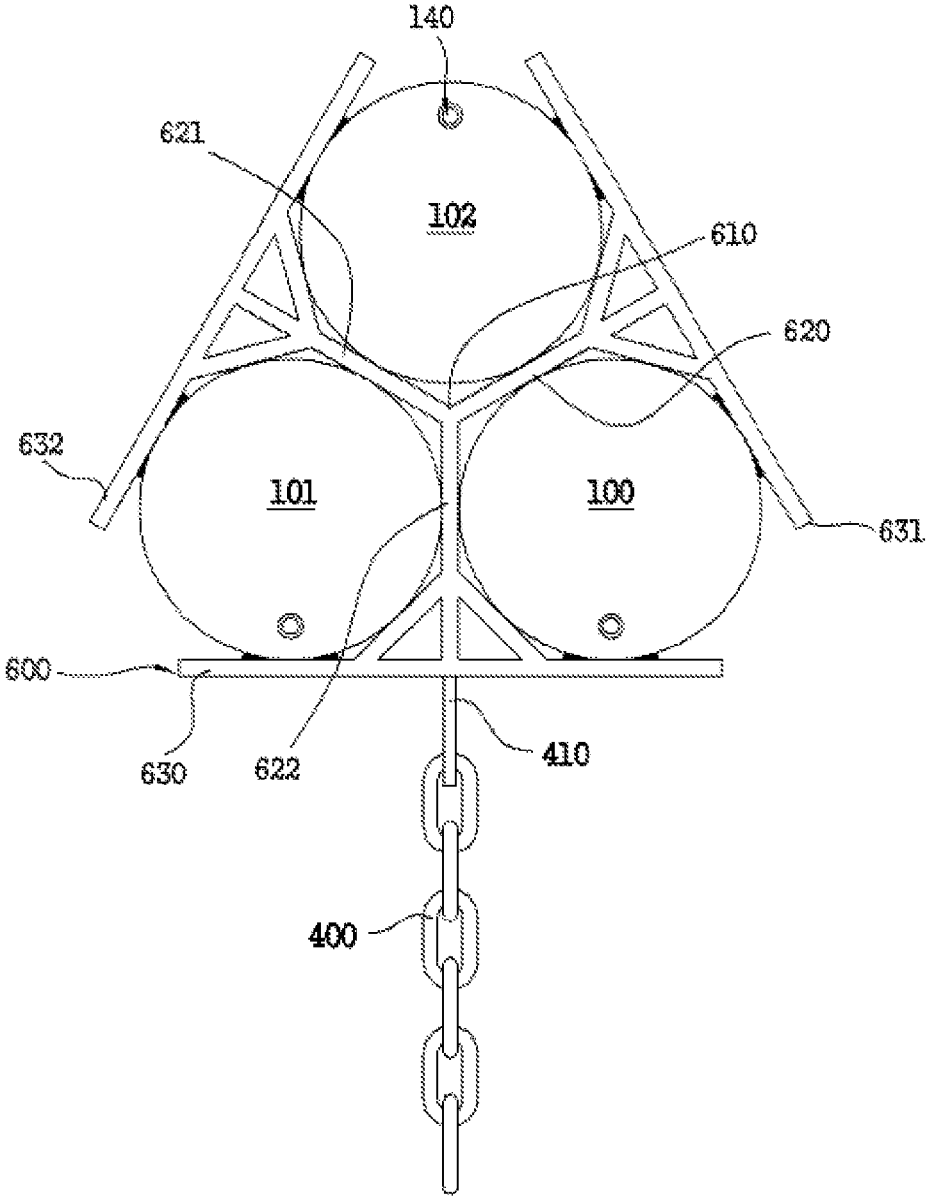
FIG. 12 is a plane view of FIG. 11.
Figure 13:
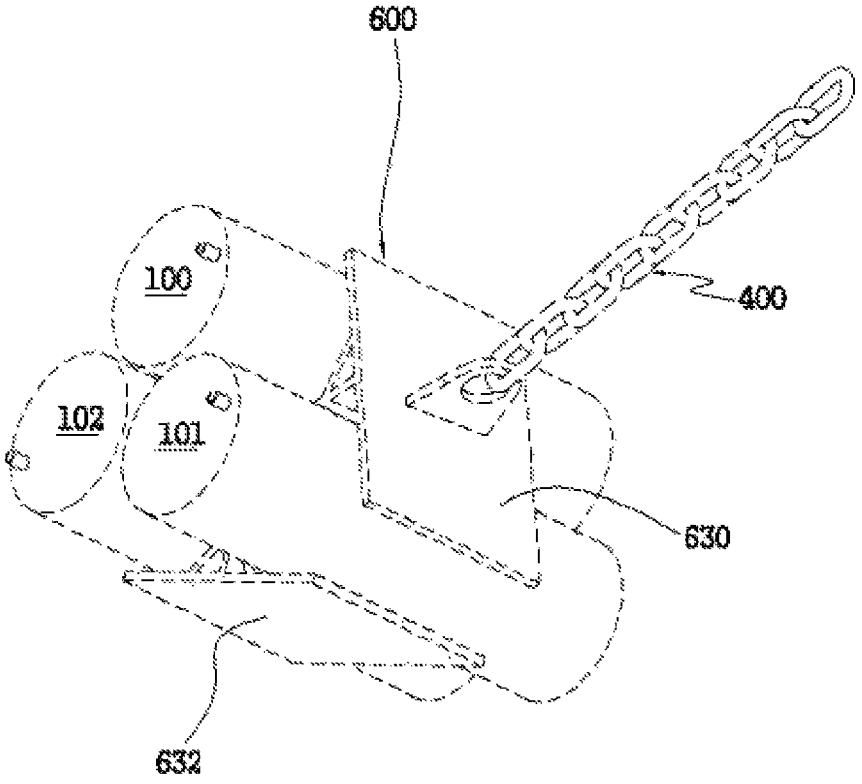
FIG. 13 is a perspective view showing that the multi-suction pile of FIG. 11 has penetrated into the sea floor.

As shown in FIGS. 11 to 13, a suction anchor of the present invention comprises three suction piles 100, 101, 102 arranged to have a triangular structure, a triangular coupling plate 600 integrally attached to the suction piles 100, 101, 102, and a connecting cable 400 having one end connected to the triangular coupling plate 600 and the other end connected to a marine structure. The suction piles 100, 101, 102 respectively have a hollow cylindrical shape, and each suction pile has an opening 120 formed at a bottom surface thereof to be opened downwards for suction and a drainage hole 140 formed a top surface thereof, and therefore, the suction piles 100, 101, 102 will penetrate into a sea floor by suction.

In a plane view, the suction piles 100, 101, 102 are arranged in a triangular form, and thus when the suction piles 100, 101, 102 penetrate into a sea floor, it is possible to ensure a great anchor capacity and a great pullout resistance. In the arrangement of the suction piles of the anchor, the same components as in the first to third embodiments are not described in detail here.

The triangular coupling plate 600 includes a central member 610 located between the suction piles 100, 101, 102, three blades 620, 621, 622 located in a radial shape from on the central member 610 between the suction piles, and restraining plates 630, 631, 632 respectively coupled to the blades 620, 621, 622 so that central portions of the restraining plates 630, 631, 632 are integrally coupled by welding or a padeye to restrain the suction piles 100, 101, 102 located between the blades. One end of the connecting cable 400 is connected to a marine structure, and the other end of the connecting cable 400 is connected to any one of the restraining plates 630, 631, 632.

In addition, hereinafter, a plate anchor having suction piles according to an embodiment of the present invention will be described in detail with reference to the accompanying drawings. Here, the terms "upper", "lower", "front" and "rear" as well as other terms representing directions are used for explaining the figures.

<Fifth Embodiment>

Figure 14:
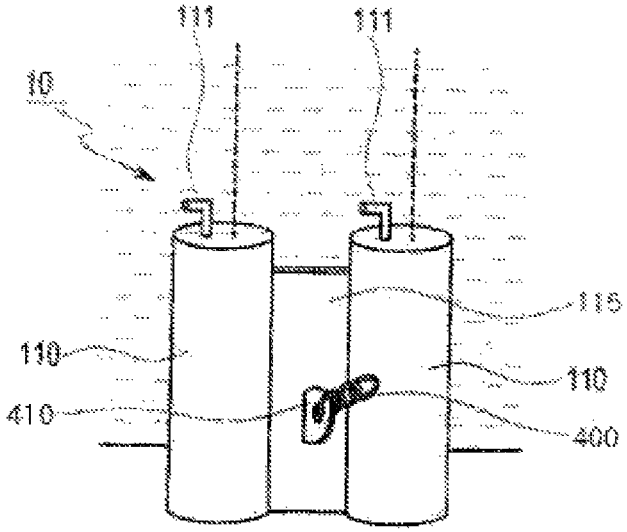
FIG. 14 is a perspective view showing a plate anchor according to a fifth embodiment of the present invention.
Figure 15:
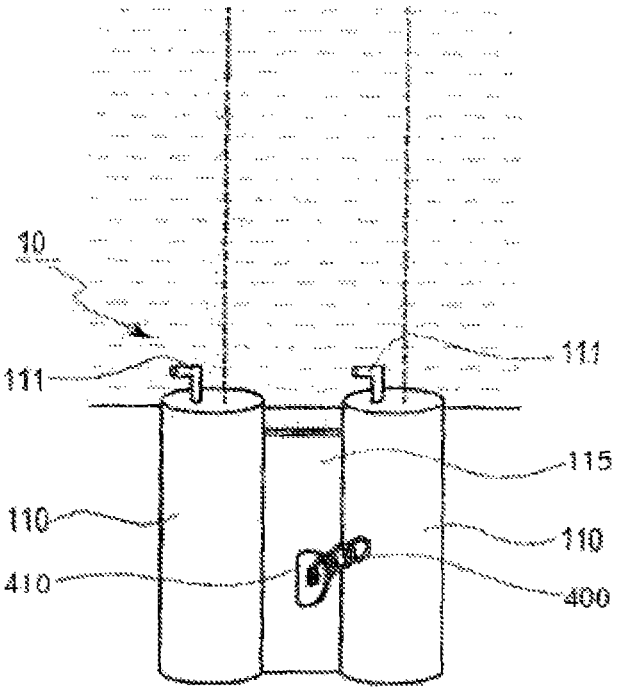
FIG. 15 is a perspective view showing that the plate anchor of the fifth embodiment has penetrated into the sea floor.

FIG. 14 is a perspective view showing a "plate anchor having suction piles" according to a fifth embodiment of the present invention, and FIG. 15 is a perspective view showing that the "plate anchor having suction piles" according to the firth embodiment penetrates into a sea floor.

The "plate anchor 10 having suction piles" according to the fifth embodiment of the present invention comprises a plurality of suction piles 110 and a connecting flat plate 115.

The suction pile 110 is a cylindrical member having a closed top and an opened bottom, and the suction pile 10 penetrates into the sea floor by a differential water pressure on the inside and outside of the suction pile due to pumping water of the inside of the suction pile out.

A pump connector 111 is provided at a top of the suction pile 110.

The connecting flat plate 115 is provided between a pair of suction piles 110, and therefore, the pair of suction piles 110 will be united by the connecting flat plate 115.

In the plate anchor 10 having a suction pile according to the present invention, the lateral and the vertical lengths of the connecting flat plate 115 may be increased or decreased within an expectable range.

The plate anchor 10 having a suction pile according to the fifth embodiment of present invention comprises two suction piles 110, and one connecting flat plate 115 for connecting the suction piles 110 each other.

In addition, a padeye 410 is provided at a front center of the connecting flat plate 115, and therefore, the connecting cable 400 is connected to the padeye 410.

<Sixth Embodiment>

Figure 16:
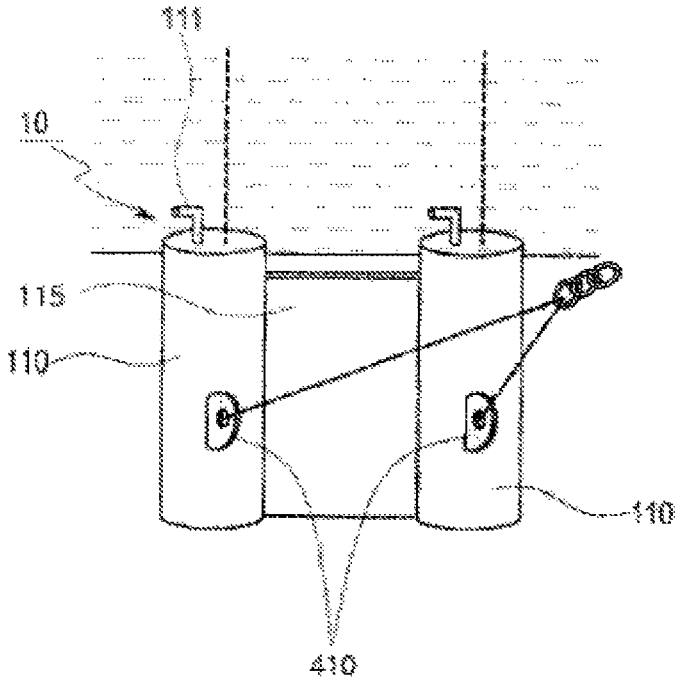
FIG. 16 is a perspective view showing that a plate anchor according to a sixth embodiment has penetrated into the sea floor.

FIG. 16 is a perspective view showing that a plate anchor having suction piles according to a sixth embodiment penetrates into the sea floor. The plate anchor 10 having suction piles according to the sixth embodiment of present invention comprises two suction piles 110, and one connecting flat plate 115 for connecting suction piles 110 each other, similar to the fifth embodiment described above.

The plate anchor 10 having a suction pile according to the sixth embodiment of present invention comprises padeyes 410 provided at front sides of the outer circumferences of the suction piles 110, respectively. Therefore, the connecting cables 400 are connected to the padeyes 410, respectively. This feature is what differentiates the sixth embodiment from the fifth embodiment.

<Seventh Embodiment>

Figure 17:
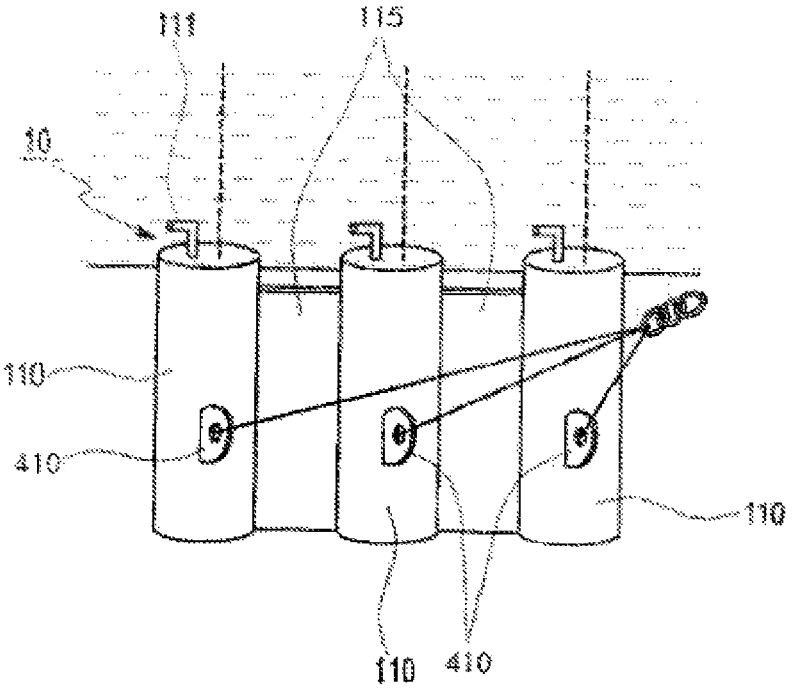
FIG. 17 is a perspective view showing that a plate anchor according to a seventh embodiment has penetrated into the sea floor.

FIG. 17 is a perspective view that a plate anchor having a suction pile according to a seventh embodiment penetrates into the sea floor. The plate anchor 10 having a suction pile according to the seventh embodiment of present invention comprises three suction piles 110 spaced apart from each other with equal gaps, and two connecting flat plates 115. In the plate anchor 10 having a suction pile according to the seventh embodiment of present invention, one connecting flat plate 115 is provided between the left suction pile 110 and the central suction pile 110, and the other connecting flat plate 115 is provided between the central suction pile 110 and the right suction pile 110.

The plate anchor 10 having a suction pile according to the seventh embodiment of present invention comprises padeyes 410 provided at a front side of the outer circumference of each suction pile 110. Therefore, the connecting cables 400 are connected to the padeyes 410, respectively.

The plate anchor 10 having a suction pile according to the fifth to seventh embodiments of the present invention moor a floating marine structure by using the connecting cables 400 while the suction piles 110 remain embedded in the sea floor.

<Eighth Embodiment>

Figure 18:
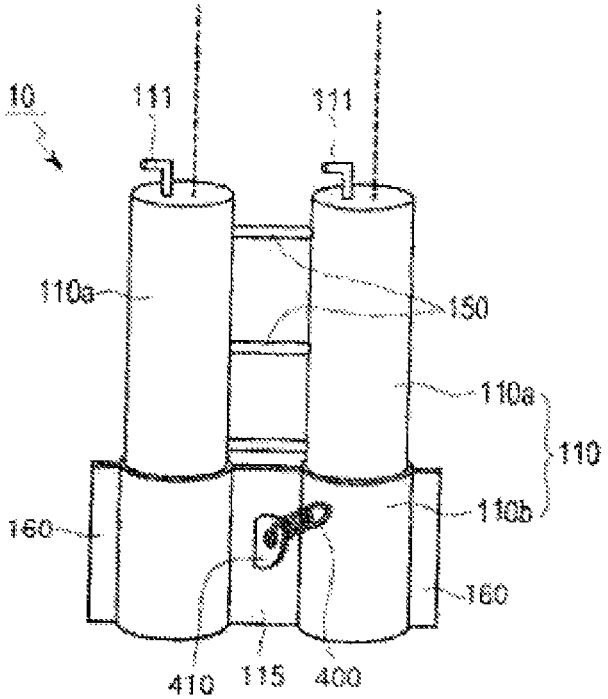
FIG. 18 is a perspective view showing a plate anchor according to an eighth embodiment.
Figure 19A:
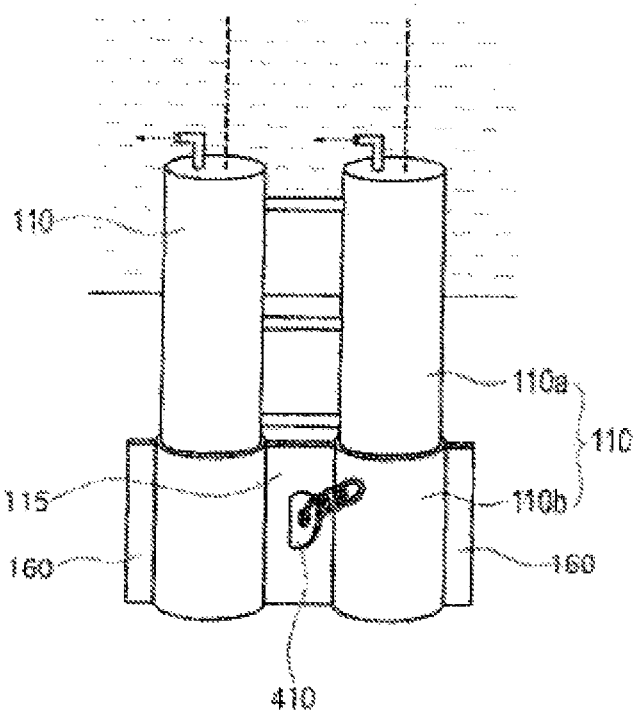
FIGS. 19*a* and 19*b* are perspective views showing that a plate anchor according to an eighth embodiment has penetrated into the sea floor, respectively.
Figure 19B:
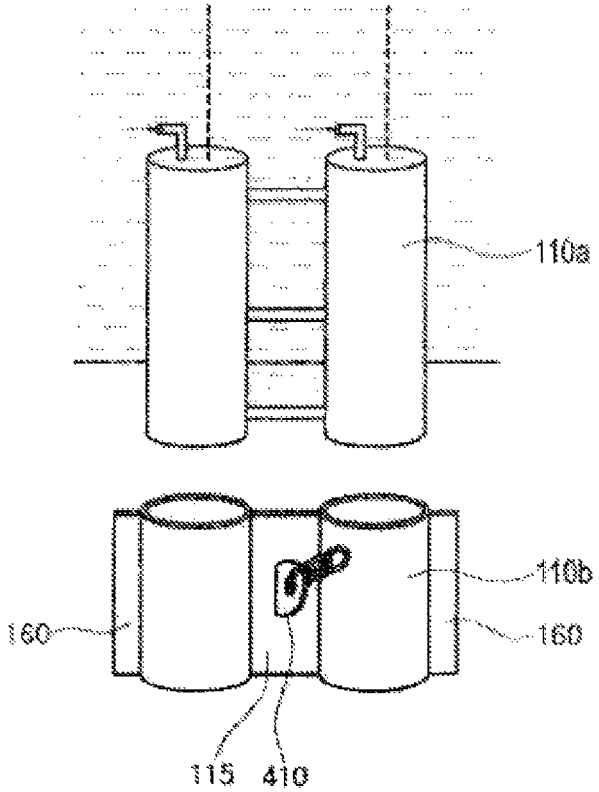

FIG. 18 is a perspective view showing a plate anchor having suction piles according to an eighth embodiment, and FIGS. 19*a* and 19*b* are perspective views showing that the plate anchor having suction piles according to the eighth seventh embodiment penetrates into the sea floor, respectively.

In the plate anchor 10 having suction piles according to the eighth embodiment of the present invention as shown in FIGS. 18 to 19*b*, the suction pile 110 may be partially reusable.

The plate anchor 10 having suction piles according to the eighth embodiment of the present invention comprises two suction piles 110 and one connecting flat plate 115.

In addition, each suction pile 110 includes a reuse unit (a portion to be reused) 110*a*, and a penetrating unit 110*b* detachably connected to a lower portion of the reuse unit 110*a*.

In the plate anchor 10 having suction piles according to the eighth embodiment of the present invention, the connecting flat plate 115 is provided between the penetrating units 110*b* of both suction piles 110.

A padeye 410 is provided at a front center of the connecting flat plate 115. Therefore, the connecting cable 400 is connected to the connecting flat plate 115.

In the plate anchor 10 having suction piles according to the eighth embodiment of the present invention, a reinforcement plate 160 is provided at an outer side of the penetrating unit 110*b* of each suction pile 110.

In the plate anchor 10 having suction piles according to the eighth embodiment of the present invention, a connection member 150 is provided between the reuse units 110*a* of the suction piles 110.

The plate anchor 10 having suction piles according to the eighth embodiment of the present invention penetrates into the sea floor in a state where the penetrating unit 110*b* is combined with the lower portion of the reuse unit 110*a* of each suction pile 110, as shown in FIG. 19*a*.

After the plate anchor 10 has penetrated into the sea floor as shown in FIG. 19*b*, the penetrating unit 110*b* will be separated from the reuse unit 10*a*, and further, the reuse unit 100*a* of the suction pile 110 is filled with water to be pulled out from the sea floor. The reuse unit 110*a* pulled out from the sea floor may be used again.

In the plate anchor 10 having suction piles according to the eighth embodiment of the present invention, the reuse unit 110*a* and the penetrating unit 110*b* of the suction pile 110 may be detachably connected through a hydraulic jack or another known technique, even though not illustrated in detail.

<Ninth Embodiment>

Figure 20:
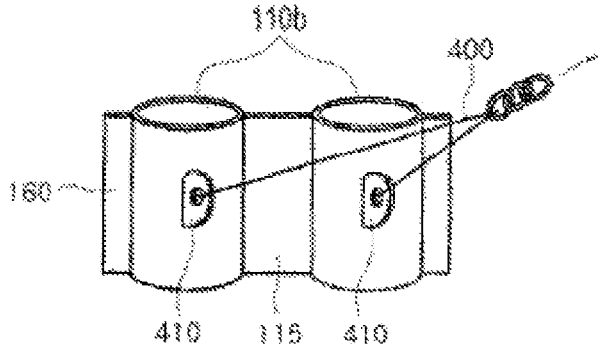
FIG. 20 is a perspective view showing that a plate anchor according to a ninth embodiment has penetrated into the sea floor.

FIG. 20 is a perspective view showing a penetrating unit of a plate anchor having suction piles according to a ninth embodiment.

The plate anchor 10 having suction piles according to the ninth embodiment of the present invention comprises a connecting flat plate 115 between two penetrating units 110*b*, similar to the eighth embodiment described above, and a reinforcement plate 160 is provided at an outer side of each penetrating unit 110*b*.

The plate anchor 10 having suction piles according to the ninth embodiment of the present invention includes padeyes 410 provided at front portions of the outside of both penetrating settling units 110*b*. Therefore, the connecting cable 400 is connected the padeye 410, respectively. This feature is what differentiates the ninth embodiment from the eighth embodiment.

<Tenth Embodiment>

Figure 21:
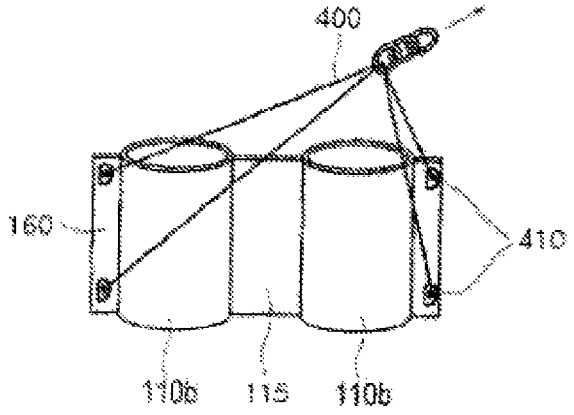
FIG. 21 is a perspective view showing that a plate anchor according to a tenth embodiment has penetrated into the sea floor.

FIG. 21 is a perspective view showing a penetrating unit of a plate anchor having suction piles according to a ninth embodiment. The plate anchor 10 having suction piles according to the tenth embodiment of the present invention includes padeyes 410 respectively provided to front top and bottom of the reinforcement plate 160 provided at an outer side of the penetrating unit 110*b*. Therefore, the connecting cable 400 is connected the padeyes 410, respectively.

The plate anchor 10 having suction piles according to the eighth to tenth embodiments of the present invention may allow the reuse unit of the suction pile 110 to be reused by separately drawing the reuse unit 110*a* at the top of the suction pile 110 from the penetrating unit 110*b* after the penetrating unit 110*b* at the bottom of the suction pile 110 has penetrated into the sea floor.

The plate anchor 10 having suction piles according to each embodiment of the present invention may enhance a lateral resistance without increasing the size of the suction pile 110, and since a plurality of suction piles 110 is used, a sufficient intrusive force may be ensured.

While the exemplary embodiments have been shown and described, it will be understood by those skilled in the art that various changes in form and details may be made thereto without departing from the spirit and scope of the present invention as defined by the appended claims.

What is claimed is:

1. A method for constructing a multi-suction pile anchor, comprising:

a step of setting a number of suction piles according to a pullout resistance demanded for mooring a marine structure;

a suction pile parallel-arrangement step of arranging the suction piles in parallel;

a suction pile fixing step of integrally coupling a coupling plate to the suction piles, so that the suction piles are integrated;

a suction pile position fixing step of placing the assembled suction piles on a sea floor to penetrate to a predetermined depth by a weight thereof;

a suction pile penetration step of pumping water out from a hollow inside of the suction piles through a drainage hole for a suction pressure so that the suction piles penetrate into the sea floor with a designed depth by the suction pressure; and a marine structure restraining step of connecting a connecting cable connected to the coupling plate, to the marine structure for mooring the marine structure, after the suction piles have entirely penetrated into the sea floor.

* * * * *